US009528701B2

(12) United States Patent
Hughes

(10) Patent No.: US 9,528,701 B2
(45) Date of Patent: Dec. 27, 2016

(54) SYSTEM FOR TUNING A COMBUSTOR OF A GAS TURBINE

(71) Applicant: General Electric Company, Schenectady, NY (US)

(72) Inventor: Michael John Hughes, Pittsburgh, PA (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 844 days.

(21) Appl. No.: 13/833,878

(22) Filed: Mar. 15, 2013

(65) Prior Publication Data

US 2014/0260278 A1 Sep. 18, 2014

(51) Int. Cl.
*F23R 3/00* (2006.01)
*F23R 3/46* (2006.01)

(52) U.S. Cl.
CPC ..... *F23R 3/002* (2013.01); *F23R 3/005* (2013.01); *F23R 3/46* (2013.01); *F23R 2900/03043* (2013.01); *F23R 2900/03044* (2013.01)

(58) Field of Classification Search
CPC ... F23R 3/002; F23R 3/02; F23R 2900/03043; F23R 2900/00014; F01D 9/023
See application file for complete search history.

(56) References Cited

U.S. PATENT DOCUMENTS

| | | | | |
|---|---|---|---|---|
| 6,484,505 | B1 | 11/2002 | Brown et al. | |
| 7,493,767 | B2 * | 2/2009 | Bunker | F23R 3/002 60/752 |
| 7,707,835 | B2 | 5/2010 | Lipinski et al. | |
| 8,590,314 | B2 * | 11/2013 | McMahan | F23M 5/085 60/752 |
| 2010/0170256 | A1 | 7/2010 | Kaleeswaran et al. | |
| 2011/0214429 | A1 | 9/2011 | Chen et al. | |
| 2011/0247341 | A1 * | 10/2011 | McMahan | F23M 5/085 60/757 |

* cited by examiner

*Primary Examiner* — Patrick Hamo
(74) *Attorney, Agent, or Firm* — Dority & Manning, PA

(57) ABSTRACT

A system for tuning a combustor of a gas turbine includes a flow sleeve having an annular main body. The main body includes an upstream end, a downstream end, an inner surface and an outer surface. A cooling channel extends along the inner surface of the main body. The cooling channel extends at least partially between the downstream end and the upstream end of the main body.

6 Claims, 7 Drawing Sheets

FIG. —1—
PRIOR ART

SYSTEM FOR TUNING A COMBUSTOR OF A GAS TURBINE

FEDERAL RESEARCH STATEMENT

This invention was made with Government support under Contract No. DE-FC26-05NT42643, awarded by the Department of Energy. The Government has certain rights in this invention.

FIELD OF THE INVENTION

The present invention generally relates to a system for tuning a combustor of a gas turbine. More particularly, this invention relates to a flow sleeve that defines an annular flow path through the combustor.

BACKGROUND OF THE INVENTION

In a gas turbine, multi-can combustors communicate with each other acoustically due to connections between various cans. Large pressure oscillations, also known as combustion dynamics, result when the heat release fluctuations in the combustors are coupled with the acoustic tones of each of the combustors. In some instances, the acoustic tones of one combustor can is in phase with an adjacent combustor can, while other tones are out of phase with the adjacent combustor can.

In-phase tones are particularly a concern because of their ability to excite turbine blades disposed downstream from the combustor cans. For example, the in-phase tones may coincide with the natural frequency of the blades, thereby impacting the mechanical life of the blades. The in-phase tones are particularly of concern when instabilities between the adjacent cans are coherent (i.e., there is a strong relationship in the frequency and the amplitude of the instability from one can to the next can). Such coherent in-phase tones can excite the turbine blades and lead to durability issues, thereby limiting the operability of the gas turbine.

Current solutions to control in-phase coherent tones include ensuring that the in-phase coherent tones near the turbine blade natural frequency are of much smaller amplitude compared to the typical design practice limits. However, this approach means that the operability limits of the gas turbine could be diminished by the in-phase coherent tones. Another current approach includes changing combustor fuel splits to either shift the combustor instability frequency away from the turbine blade natural frequency or to lower the amplitude. Another solution to control in-phase coherent tones includes increasing or decreasing the overall length of the combustor. However, this solution affects emissions performance and other dynamics frequencies and is not a viable solution for existing gas turbines already in the field. Accordingly, an improved system for controlling in-phase coherent tones within the combustors of a gas turbine would be useful.

BRIEF DESCRIPTION OF THE INVENTION

Aspects and advantages of the invention are set forth below in the following description, or may be obvious from the description, or may be learned through practice of the invention.

One embodiment of the present invention is a system for tuning a combustor of a gas turbine. The system generally includes a flow sleeve having an annular main body. The main body includes an upstream end, a downstream end, an inner surface and an outer surface. A cooling channel extends along the inner surface of the main body. The cooling channel extends at least partially between the downstream end and the upstream end of the main body.

Another embodiment of the present invention is a system for tuning a combustor of a gas turbine. The system includes a flow sleeve having an annular main body. The main body includes an upstream end, a downstream end, an inner surface and an outer surface. A rail member extends inward from the main body inner surface. The rail member extends at least partially between the downstream end and the upstream end of the main body.

Another embodiment of the present invention includes a combustor for a gas turbine. The combustor includes an outer casing and an annular combustion liner that extends axially through a portion of the outer casing. The combustion liner includes a forward end, and aft end and an outer surface that extends between the forward and aft ends. The combustor further includes a system for tuning the combustor. The system comprises a flow sleeve that circumferentially surrounds at least a portion of the combustion liner. The flow sleeve includes an annular main body having an upstream end, a downstream end, an inner surface and an outer surface. The flow sleeve is radially separated from the liner so as to define an annular flow passage therebetween. The system further includes a means for extending an axial flow distance through the annular flow passage.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
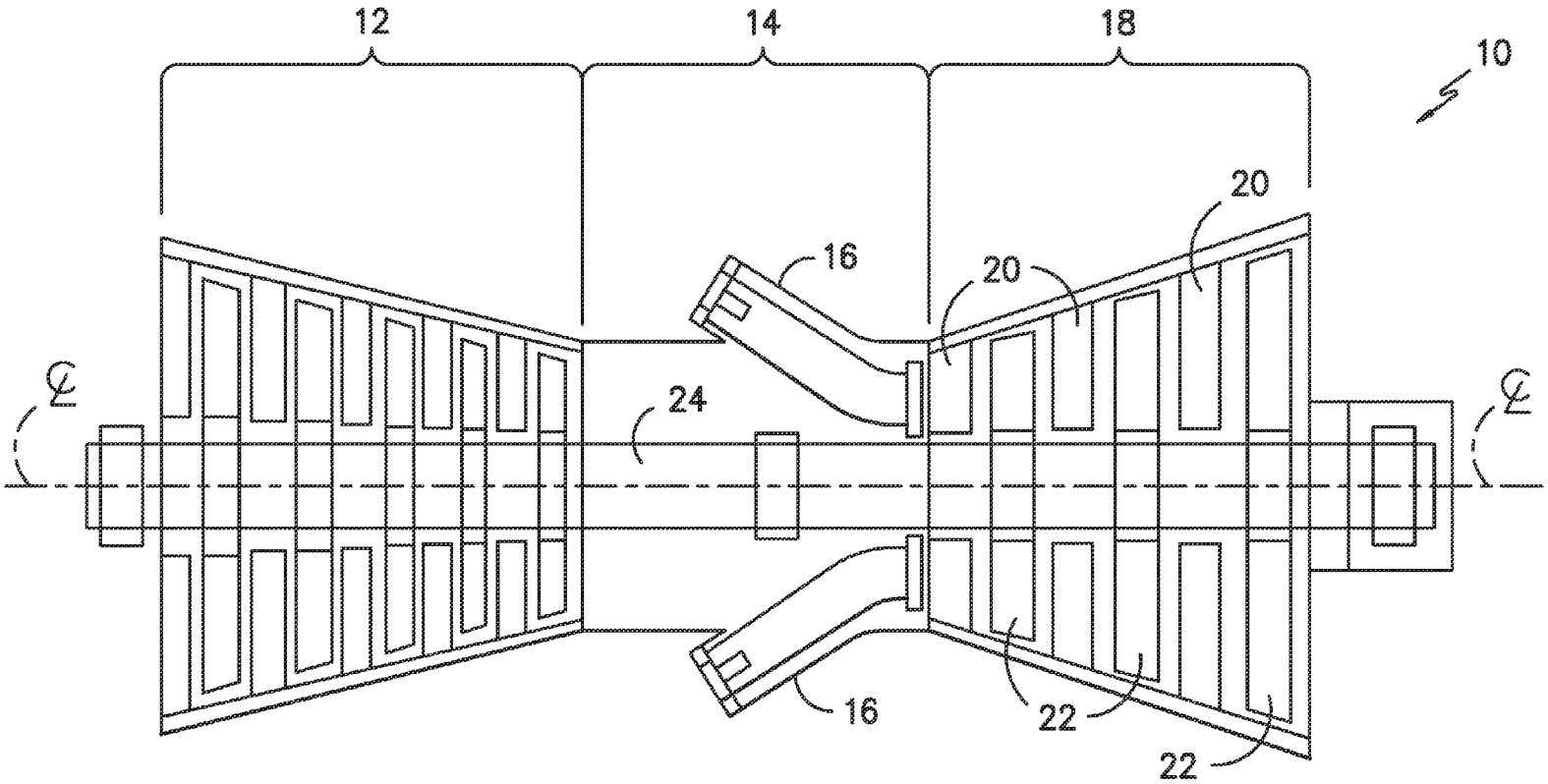
FIG. 1 illustrates a simplified cross-section of an exemplary combustion section 10 such as may be included in a gas turbine.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. In addition, the terms "upstream" and "downstream" refer to the relative location of components in a fluid pathway. For example, component A is upstream from component B if a fluid flows from component A to component B. Conversely, component B is downstream from component A if component B receives a fluid flow from component A.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Referring now to the drawings, FIG. 1 illustrates an example of a known gas turbine 10. As shown, the gas turbine 10 generally includes a compressor section 12 disposed at an upstream end of the gas turbine 10, a combustion section 14 having at least one combustor 16 downstream from the compressor section 12, and a turbine section 18 downstream from the combustion section 14. The turbine section IS generally includes alternating stages of stationary nozzles 20 and turbine rotor blades 22 disposed within the turbine section 18 along an axial centerline of a shaft 24 that extends generally axially through the gas turbine 10.

Figure 2:
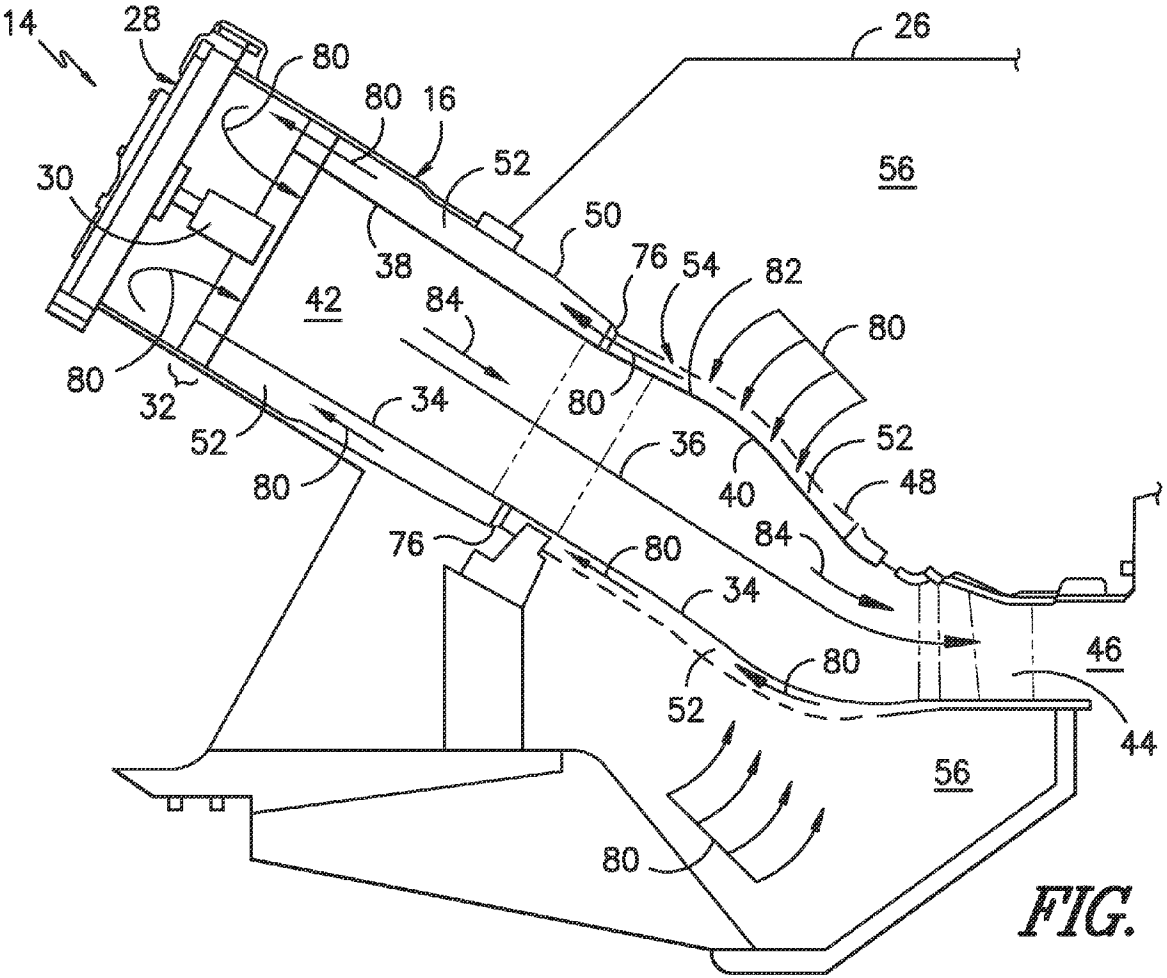
FIG. 2 illustrates a cross section perspective view of the a portion of the combustion section as shown in FIG. 1.

FIG. 2 provides a simplified cross-section of the combustion section 14 as shown in FIG. 1. As shown, the combustion section 14 generally includes a casing 26 that at least partially encloses the combustor 16. An end cover 28 is connected to a portion of the casing 26 at one end of the combustor 16. At least one fuel nozzle 30 extends axially downstream from the end cover 28. The at least one fuel nozzle 30 extends at least partially through a cap assembly 32 that extends radially within the casing 26.

Various hot gas path components 34 extend downstream from the cap assembly 32 so as to define a hot gas path 36 that extends through the casing 26. The hot gas path components 34 generally include an annular combustion liner 38 and an annular transition duct 40. The combustion liner 38 extends downstream from the cap assembly 32. A combustion chamber 42 is at least partially defined within the combustion liner 38 downstream from the at least one fuel nozzle 30. The transition duct 40 extends downstream from the combustion liner 38 and terminates adjacent to a first stage nozzle 44 that is disposed adjacent to an inlet 46 of the turbine section 18. The combustion liner 38 and the transition duct 40 may be formed as a singular liner or may be provided as separate components.

An annular impingement sleeve 48 at least partially surrounds the transition duct 40. An annular flow sleeve 50 at least partially surrounds the combustion liner 38. In particular embodiments, the flow sleeve 50 may at least partially surround both the transition duct 40 and the combustion liner 38. In other embodiments, the flow sleeve 50 may fully surround the transition duct and the combustion liner 38. An annular flow passage 52 is partially defined between the impingement sleeve 48 and the transition duct 40. The annular flow passage 52 is further defined between the flow sleeve 50 and the combustion liner 38. The impingement sleeve 48 generally includes a plurality of cooling passages 54 that define a flow path between a plenum 56 defined within the combustion section casing 26 and the annular flow passage 52.

Figure 3:
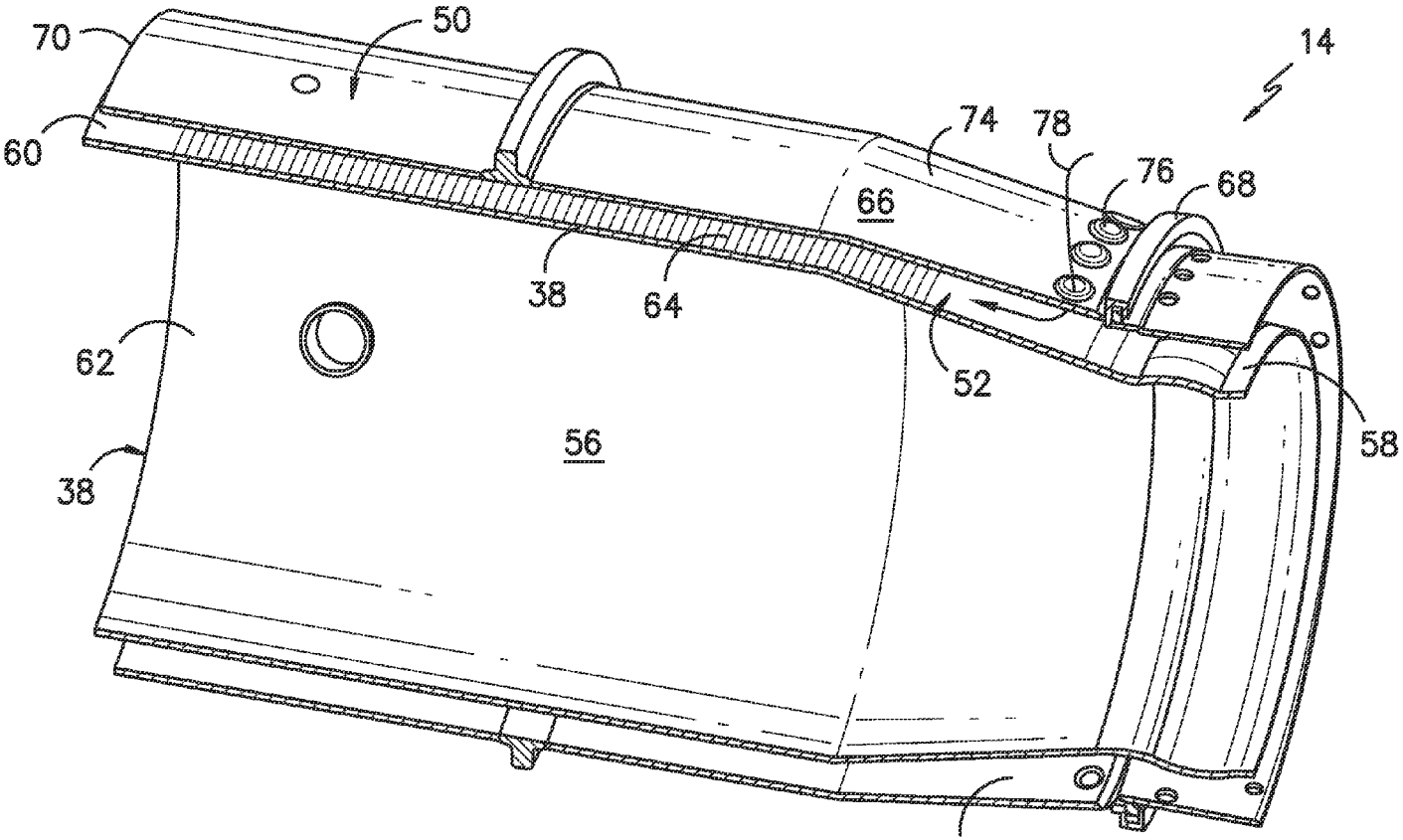
FIG. 3 illustrates a cross section perspective view of a system for tuning the combustor as shown in FIG. 1, according to one embodiment of the present disclosure.

FIG. 3 illustrates a cross section perspective view of the combustion liner 38 and the flow sleeve 50 as shown in FIG. 1. As shown in FIG. 3, the combustion liner 38 generally includes an annular main body 56. The main body 56 includes an upstream or aft end 58 axially separated from a downstream or forward end 60, and an inner surface 62 radially separated from an outer surface 64.

The flow sleeve 50 generally includes an annular main body 66. The main body 66 includes and upstream or forward end 68 axially separated from a downstream or aft end 70. The main body 66 further includes an inner surface 72 radially separated from an outer surface 74. One or more inlet ports 76 extend through the flow sleeve 50 so as to define a flow path 78 between the plenum 56 (FIG. 2) and the annular flow passage 52 (FIGS. 2 and 3). In operation, as shown in FIG. 1, a working fluid such as compressed air 80 is routed into the plenum 56 of the combustion section 14 from the compressor section (FIG. 1) positioned upstream from the combustion section 14. As shown in FIG. 2, a primary portion of the compressed air 80 is routed through the cooling passages 54, 76 and into the annular flow passage 52. In this manner, the compressed air 80 is used to provide impingement, convective, and/or conductive cooling an outer surface 82 of the transition duct 40 and/or to the outer surface 64 (FIG. 3) of the combustion liner 38 (FIG. 3). As shown in FIG. 2, the compressed air 80 travels along the annular flow passage 52 before reversing direction at the end cover 28. The compressed air 80 then flows past the one or more fuel nozzles 30 and through the cap assembly 32 where it is mixed with a fuel and burned in the combustion chamber 42, thereby producing a hot gas 84 that flows through the hot gas path 36, across the first stage nozzle 44 and into the inlet 46 of the turbine section 18 (FIG. 1).

An axial or acoustic distance that the compressed air 80 travels through the annular flow passage 52 before reaching the end cover 28 has an effect on the acoustic natural frequency of the combustor 16. For example, the combustor 16 will have a high natural frequency, typically in the 200 to 240 Hertz range, where the compressed air 80 flows generally axially through (i.e. the shortest distance) the annular flow passage 52. As a result, the high natural frequency may excite the turbine rotor blades 22 (FIG. 1), thereby reducing the mechanical life of the turbine rotor blades 22 and/or limiting the operability of the combustor 16. In addition, adjacent combustors having similar axial or acoustic distances through their corresponding annular flow passages may result in coherent in-phase acoustic tones that can excite the turbine rotor blades and lead to durability issues, thereby further limiting the operability of the gas turbine.

Figure 4:
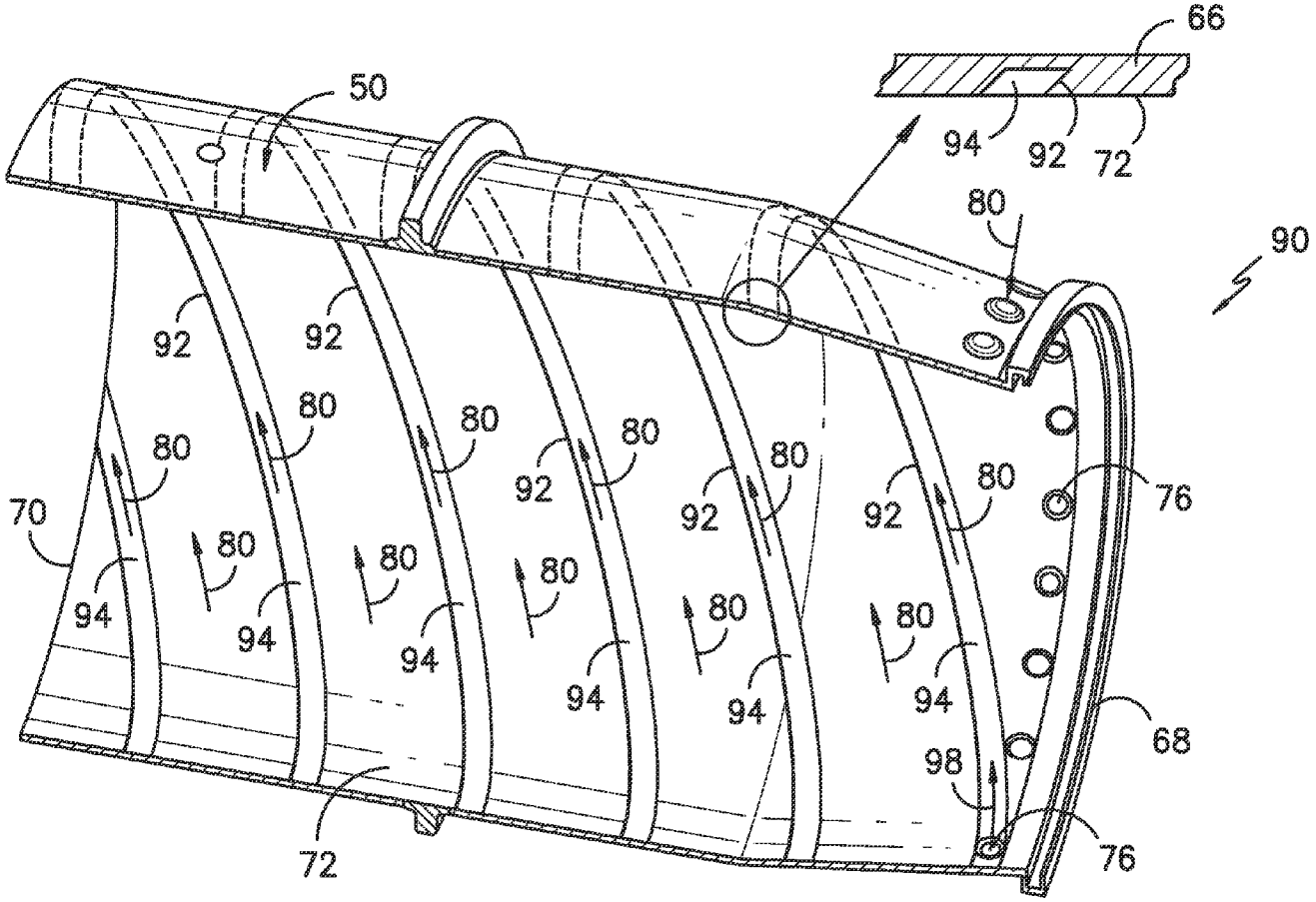
FIG. 4 illustrates a cross section perspective view of the system for tuning the combustor as shown in FIG. 3, according to at least one embodiment of the present disclosure.
Figure 5:
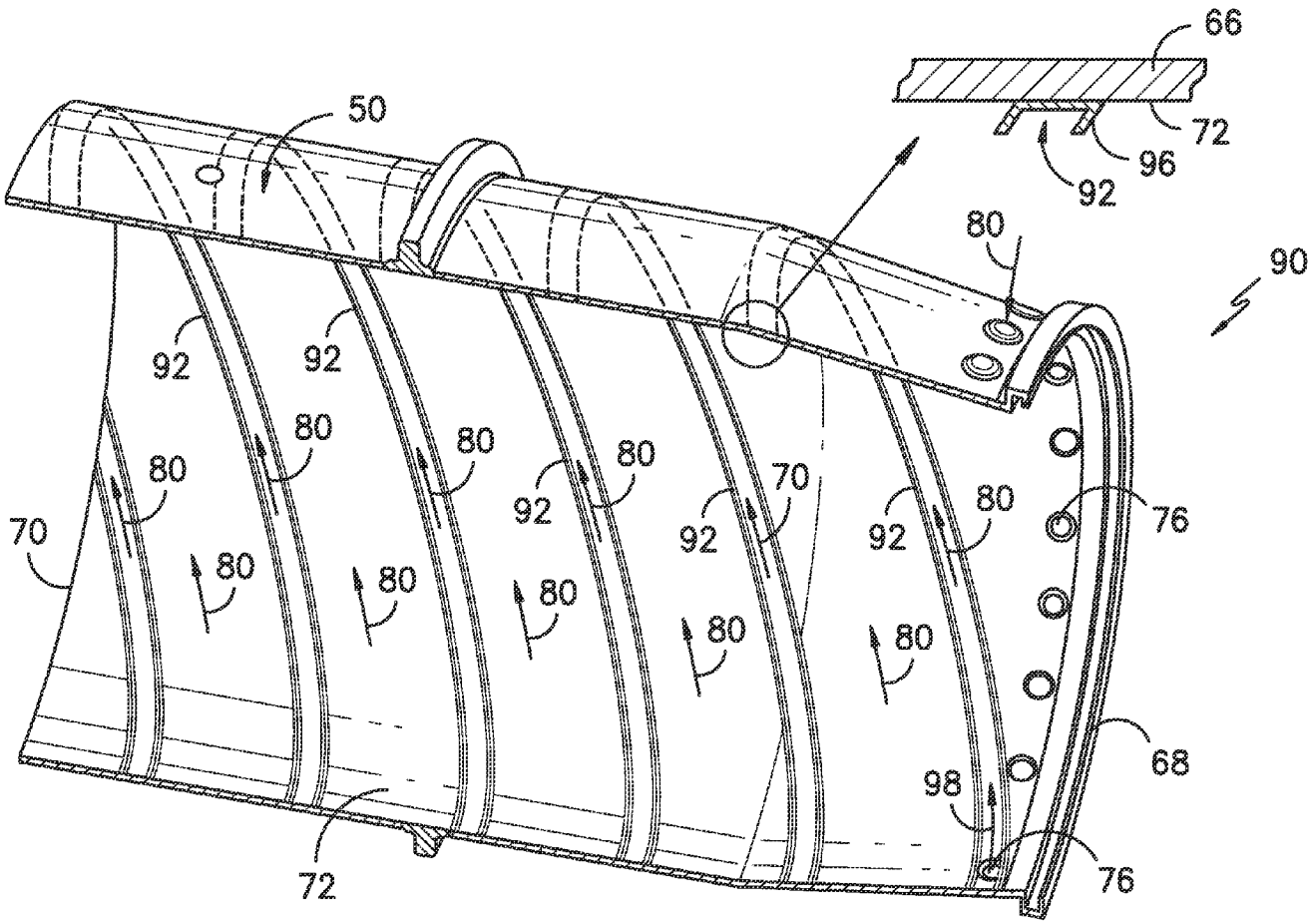
FIG. 5 illustrates a cross section perspective view of the system for tuning the combustor as shown in FIG. 3, according to at least one embodiment of the present disclosure.
Figure 6:
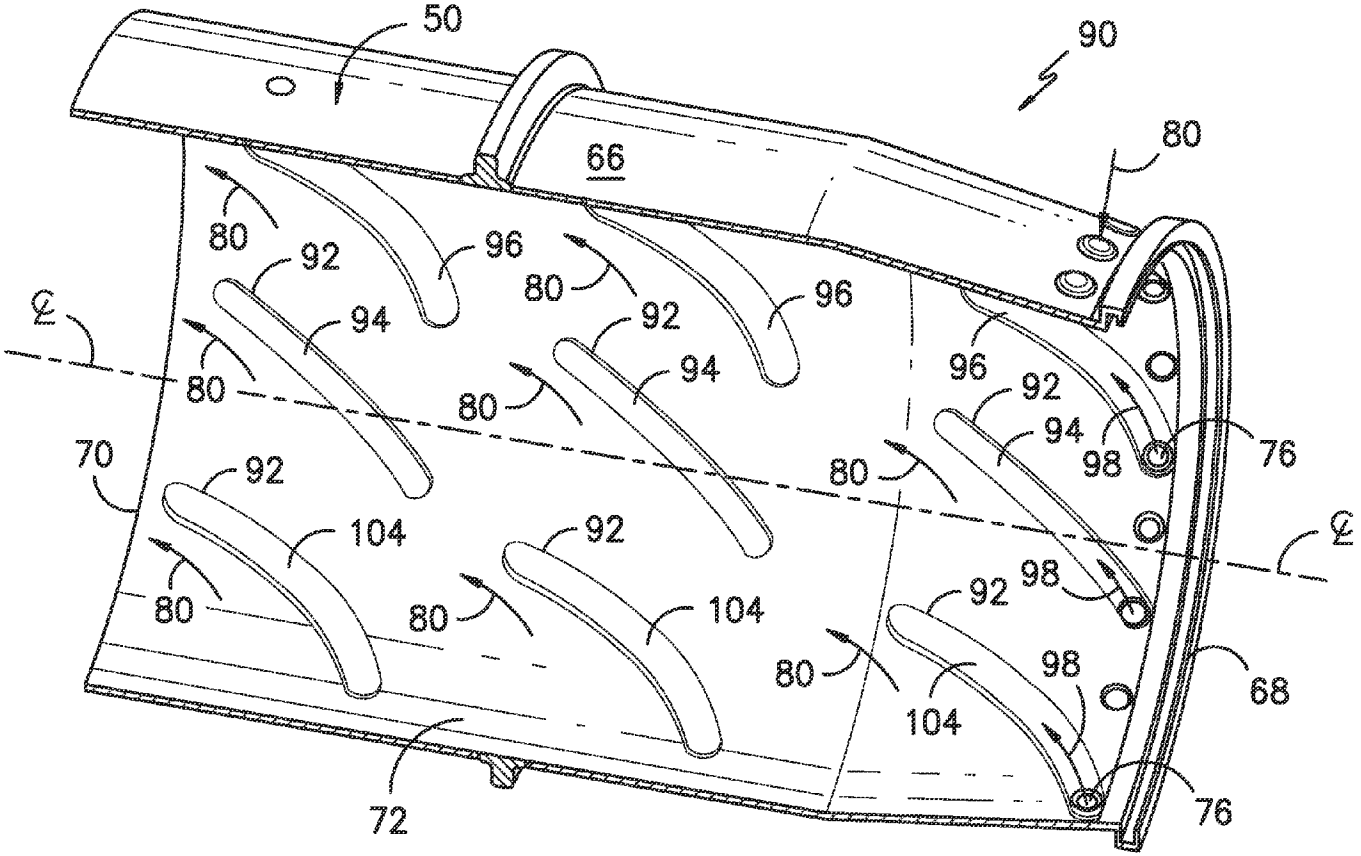
FIG. 6 illustrates a cross section perspective view of the system for tuning the combustor as shown in FIG. 3, according to at least one embodiment of the present disclosure.
Figure 7:
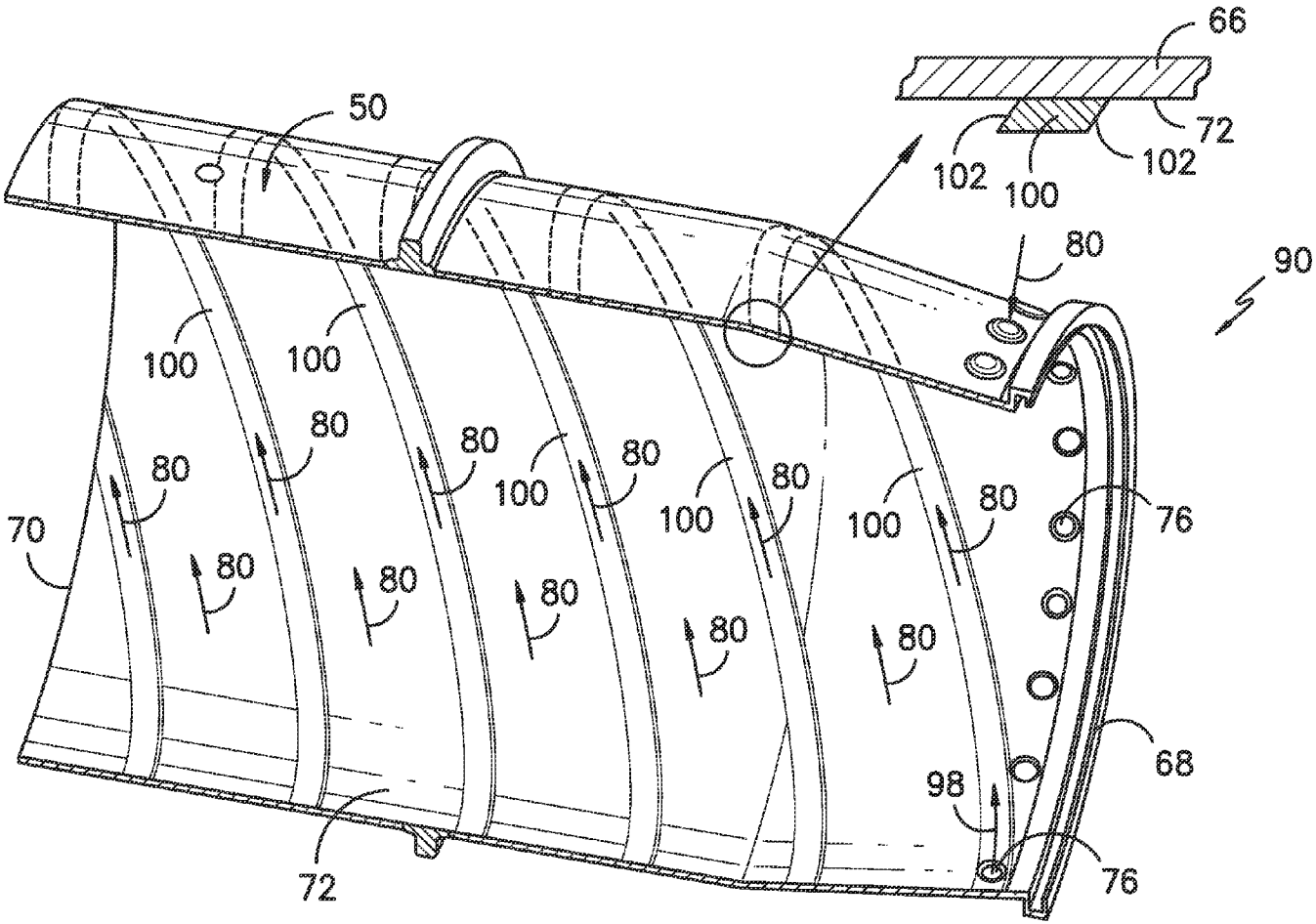
FIG. 7 illustrates a cross section perspective view of the system for tuning the combustor as shown in FIG. 3, according to at least one embodiment of the present disclosure.

FIG. 4 illustrates a system for tuning the combustor 90, herein referred to as "the system 90", according to at least one embodiment of the present disclosure. FIGS. 5, 6 and 7 illustrate various alternate embodiments of the system 90 as shown in FIG. 3.

In one embodiment, as shown in FIG. 4, the system 90 generally includes the flow sleeve 50 having a flow channel 92. The flow channel 92 extends along the inner surface 72 of the main body 66 of the flow sleeve 50 at least partially between the downstream end 70 and the upstream end 68 of the main body 66. In particular embodiments, the flow channel 92 comprises of one or more grooves or slots 94 that extend helically along the inner surface 72 of the main body 66. The groove 94 may be tapered, chamfered or otherwise shaped so as to capture and/or swirl the compressed air 80 as it flows through the annular flow passage 52 (FIG. 2). The flow channel 92 may be set at any width and/or depth suitable to capture and guide at least a portion of the compressed air 80 that flows through the flow passage 52. As shown in FIG. 4, the flow channel 92 may be at least partially defined by the main body 66. The flow channel 92 may be set at an angle with respect to an axial centerline of the flow sleeve 50 so as to control flow velocity and/or the axial or acoustic distance that the compressed air 80 travels through the annular flow passage 52. The flow channel 92 may extend at least partially through the flow sleeve 50 at a constant angle or may extend at an angle that varies along the axial length of the flow sleeve 50.

In alternate embodiments, as shown in FIG. 5, the flow channel 92 may be at least partially defined by at least one channel piece 96 connected to the inner surface 72 of the flow sleeve 50. The channel piece 96 may be tapered, chamfered or otherwise shaped so as to capture and/or swirl the compressed air 80 as it flows through the annular flow passage 52 (FIG. 2). The channel piece 96 may be at least partially defined by the main body 66 of the flow sleeve 50. In the alternative, the channel piece 96 may be formed from a sheet metal or other suitable material and brazed, welded or otherwise joined to the inner surface 72 of the flow sleeve 50.

In particular embodiments, as shown in FIGS. 4 and 5, the inlet port 76 may extend through the main body 66 and into the flow channel 92, thereby defining a flow path 98 between the annular flow passage 52 (FIG. 2) and the flow channel 92. For example, the inlet port 76 may extend into the groove 94 and/or into the channel piece 96.

In alternate embodiments, as shown in FIG. 6, the flow channel 92 may comprise of a plurality of the helically extending grooves 94 and/or channel pieces 96 extending along the inner surface 72 of the main body 66. The grooves 94 and/or the channel pieces 96 may be positioned at any point and in any configuration such as in an offset pattern between the downstream end 70 and the upstream end 68 of the main body 66 so as to tune the combustor 16 to a desired frequency.

In operation, the compressed air 80 is routed through the inlet port 76 and into the annular flow passage 52 (FIG. 3) defined between the outer surface 64 of the combustion liner 38 (FIG. 2) and the inner surface 72 of the flow sleeve 50. At least a portion of the compressed air 80 is captured by the flow channel 92 and routed helically around the inner surface 72 of the flow sleeve 50 between the upstream and the downstream ends 68, 70 of the flow sleeve 50, thereby increasing the axial or acoustic distance that the compressed air 80 travels through the annular flow passage 52. As a result, the natural acoustic frequency of the combustor 16 (FIG. 2) may be tuned so as to reduce potential excitation of the turbine rotor blades 22 (FIG. 1).

In another embodiment, as shown in FIG. 7, the system 90 includes the flow sleeve 50 and a rail member 100 that extends generally radially inward from the inner surface 72 of the main body 66 of the flow sleeve 50 with respect to an axial centerline of the flow sleeve 50. The rail member 100 extends at least partially between the downstream end 70 and the upstream end 68 of the main body 66 of the flow sleeve 50. The rail member 100 extends helically along the inner surface 72 of the main body 66. The rail member 100 may be tapered, chamfered, scooped or otherwise shaped so as to capture and/or swirl the compressed air 80 (FIG. 2) as it flows through the annular flow passage 52 (FIG. 2). The rail member 100 may be at least partially defined by the main body 66 of the flow sleeve 50. In the alternative, the rail member 100 may be formed from a sheet metal or other suitable material and brazed, welded or otherwise joined to the inner surface 72 of the flow sleeve 50.

In particular embodiments, the rail member 100 comprises of a pair of opposing sides 102. The inlet port 76 extends through the main body 66 generally adjacent to one of the pair of opposing side 102 of the rail member 100, thereby capturing the compressed air 80 as it flows from the plenum 56 (FIG. 2) of the combustion section 18 (FIG. 2) through the inlet port 76 and into the annular flow passage 52.

In alternate embodiments, as shown in FIG. 6, the rail member 100 may comprise of a plurality of helically extending rail members 104 extending along the inner surface 72 of the main body 66. The rail members 104 may be positioned at any point and in any configuration such as in an offset pattern between the downstream end 70 and the upstream end 68 of the main body 66 so as to tune the combustor 16 to a desired frequency.

It should be obvious to one of ordinary skill in the art that the system 90 may include a combination of the flow channels 92 and the rail members 100 so as to tune the combustor 16 as described herein. In addition, coherence between adjacent combustors 16 may be reduced and/or eliminated by varying the number, the geometry such as the shape, the angle, the length or the width, or any other design feature of the flow channels 92 in the flow sleeves 50 of the combustors 16. For example, the number and/or the geometry of the flow channels 92 may be varied in each or some of the flow sleeves 50 so as to adjust/tune the frequency of each of the combustors 16, thereby reducing the potential for coherence at the turbine rotor blades 22. In addition or in the alternative, the number of flow channels 92, the geometry/shape, the angle, the width, the length or any other design feature of the flow channels 92 in the flow sleeves 50 of the combustors 16 may be chosen so as to adjust the frequency of some of the combustors 16, thereby reducing the potential for producing a single tone that excites all of the turbine rotor blades 22 coherently at an undesirable frequency.

In operation, the compressed air 80 is routed through the inlet port 76 and into the annular flow passage 52 (FIG. 3) defined between the outer surface 64 of the combustion liner 38 (FIG. 3) and the inner surface 72 of the flow sleeve 50. At least a portion of the compressed air 80 is captured by the rail member 100 and is routed helically around the inner surface 72 of the flow sleeve 50 between the upstream and the downstream ends 68, 70 of the flow sleeve 50, thereby increasing the axial or acoustic distance that the compressed air 80 travels through the annular flow passage 52. As a result, the natural acoustic frequency of the combustor 16 is lowered so as to reduce potential excitation of the turbine blades 22 (FIG. 1).

In various embodiments, as shown in FIGS. 4, 5, 6 and 7, the system 80 includes various means for increasing the axial or acoustic flow distance through the annular flow passage 52 herein referred to as "the means". For example, the means may include the flow channel, the channel piece and the rail member. However, it should be obvious to one of ordinary skill in the art that the means may also include any shape or feature that has the effect of increasing the axial or acoustic flow distance through the annular flow passage 52. For example, the means may also include rails, slots, grooves, turbulators, airfoils, scoops or any raised surface or machined surface that extends along the inner surface 72 of the flow sleeve 50 at least partially between the upstream end 68 and the downstream end 70 of the main body 66 so as to increase the axial or acoustic flow distance through the annular flow passage 52.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal language of the claims.

What is claimed is:

1. A system for tuning a combustor of a gas turbine, comprising:

a cap assembly;

a liner that extends downstream from the cap assembly;

a flow sleeve that at least partially circumferentially surrounds the liner, the flow sleeve having an annular main body, the main body having an upstream end, a downstream end, an inner surface and an outer surface, wherein the flow sleeve and the liner define an annular flow passage therebetween; and a rail member extending radially inwardly from the main body inner surface into the annular flow passage, the rail member extending at least partially between the upstream end and the downstream end of the main body.

2. The system as in claim 1, wherein the rail member extends helically along the inner surface of the main body.

3. The system as in claim 1, wherein the rail member comprises of a plurality of rail members extending helically along the inner surface of the main body.

4. The system as in claim 1, wherein the rail member is at least partially defined by the main body.

5. The system as in claim 1, further comprising an inlet port that extends through the main body, wherein the inlet port is disposed generally adjacent to the upstream end of the main body.

6. The system as in claim 5, wherein the rail member includes a pair of opposing sides, the inlet port being disposed generally adjacent to one of the opposing sides.

* * * * *